US012054954B2

(12) United States Patent
Houfflyn et al.

(10) Patent No.: US 12,054,954 B2
(45) Date of Patent: Aug. 6, 2024

(54) FIRE-SAFE WALL CLADDING

(71) Applicant: RENSON SUNPROTECTION-SCREENS NV, Waregem (BE)

(72) Inventors: John Urbain Houfflyn, Waregem (BE); Elien Henriëtte Delmotte, Kortrijk (BE); Joost Benjamin Renaat De Frene, Waregem (BE)

(73) Assignee: Renson Sunprotection-Screens NV, Waregem (BE)

( * ) Notice: Subject to any disclaimer, the term of this patent is extended or adjusted under 35 U.S.C. 154(b) by 465 days.

(21) Appl. No.: 17/424,584

(22) PCT Filed: Jan. 30, 2020

(86) PCT No.: PCT/IB2020/050738
§ 371 (c)(1),
(2) Date: Jul. 21, 2021

(87) PCT Pub. No.: WO2020/157690
PCT Pub. Date: Aug. 6, 2020

(65) Prior Publication Data

US 2022/0106796 A1 Apr. 7, 2022

(30) Foreign Application Priority Data

Feb. 1, 2019 (BE) ..... 2019/5062
Feb. 26, 2019 (BE) ..... 2019/5120

(51) Int. Cl.
*E04F 13/08* (2006.01)
*E04B 1/94* (2006.01)

(52) U.S. Cl.
CPC ..... *E04F 13/083* (2013.01); *E04B 1/941* (2013.01)

(58) Field of Classification Search
CPC ..... E04F 13/083; E04F 13/0812; E04F 13/12; E04F 13/0805; E04F 13/0807; E04F 13/0808; E04B 1/941
See application file for complete search history.

(56) References Cited

U.S. PATENT DOCUMENTS 4,483,122 A * 11/1984 Crandell ..... E04F 13/0808 52/235
4,625,481 A * 12/1986 Crandell ..... E04F 13/0808 52/235

(Continued)

FOREIGN PATENT DOCUMENTS

CH 659679 A5 * 2/1987
EP 0391737 A1 10/1990

(Continued)

OTHER PUBLICATIONS

Search report for International Patent Application PCT/IB2020/050738, mailed on Apr. 24, 2020.

*Primary Examiner* — Adriana Figueroa
(74) *Attorney, Agent, or Firm* — Fresh IP PLC; Clifford D. Hyra; Aubrey Y. Chen

(57) ABSTRACT

This disclosure relates to a wall cladding, including: a supporting structure; a safety supporting structure; wall cladding elements; at least one structure attachment element made of plastic; at least one cladding attachment element per wall cladding element, where the cladding attachment element forms part of the wall cladding element or is attached thereto and is couplable to the structure attachment element; at least one safety attachment element per wall cladding element, where the safety attachment element forms part of the wall cladding element or is attached thereto; and at least one safety element per wall cladding element, where the (Continued)

safety element is designed to be fire-resistant, is attachable to the safety supporting structure, and is attachable to the safety attachment element.

15 Claims, 7 Drawing Sheets

(56) References Cited

U.S. PATENT DOCUMENTS

| | | | | |
|---|---|---|---|---|
| 5,158,392 | A * | 10/1992 | Takeda | E04F 13/0808 52/235 |
| 10,844,611 | B2 * | 11/2020 | Franklin | E04F 13/12 |
| 10,851,548 | B2 * | 12/2020 | Ochi | E04F 13/0807 |
| 2010/0031597 | A1 * | 2/2010 | Baek | F16B 37/045 52/489.1 |
| 2010/0325997 | A1 * | 12/2010 | Scully | E04F 13/0805 52/489.1 |
| 2016/0053494 | A1 * | 2/2016 | White | E04B 1/388 52/698 |
| 2016/0145875 | A1 * | 5/2016 | Scully | E04F 13/14 52/698 |

FOREIGN PATENT DOCUMENTS

| | | | |
|---|---|---|---|
| FR | 1477437 | A | 4/1967 |
| WO | 2008064896 | A2 | 6/2008 |
| WO | 2018220480 | A1 | 12/2018 |

* cited by examiner

FIRE-SAFE WALL CLADDING

FIELD OF THE DISCLOSURE

This disclosure relates to a wall cladding, comprising:
- a supporting structure;
- wall cladding elements;
- at least one structure attachment element made of plastic which is attachable to the supporting structure;
- and at least one cladding attachment element per wall cladding element, which cladding attachment element forms part of said wall cladding element or is attached thereto and is couplable to the structure attachment element so as to attach the wall cladding element to the supporting structure.

BACKGROUND

Typical wall claddings are known in the art at, for example, WO 2018/220480 A1.

Such wall claddings are typically used to clad walls, such as building walls. However, it is also possible for such wall claddings to be designed such that freestanding walls can be formed thereby.

In this case, the supporting structure may take various forms, such as a wall and/or beams attached thereto and/or profiles or a standalone structure with posts and/or beams attached thereto and/or profiles, etc.

In such a case, the wall cladding elements of such wall claddings may also take various forms, from tiles and panels to slats, and may also be made of various materials, such as of wood, plastic, aluminium, etc.

However, such wall claddings with structure attachment elements made of plastic are not fire safe, given that the structure attachment elements made of plastic melt in a fire and as a result the wall cladding elements may come loose and fall.

Comparable structure attachment elements made from fire-resistant materials are much more difficult to produce with comparable functionalities and are much more expensive to produce even with more limited functionalities.

SUMMARY

The object of this disclosure is to provide such wall claddings with the advantages of wall claddings with structure attachment elements made of plastic but which are designed to be fire resistant.

The term "fire-resistant materials" is understood to mean materials that retain their structure and functionality for a certain time in a fire.

This object of the disclosure is achieved by providing a wall cladding, comprising:
- a supporting structure;
- a safety supporting structure;
- wall cladding elements;
- at least one structure attachment element made of plastic which is attachable to the supporting structure;
- at least one cladding attachment element per wall cladding element, which cladding attachment element forms part of said wall cladding element or is attached thereto and is couplable to the structure attachment element so as to attach the wall cladding element to the supporting structure;
- and at least one safety attachment element per wall cladding element, which safety attachment element forms part of said wall cladding element or is attached thereto, and at least one safety element per wall cladding element, which safety element is designed to be fire resistant, is attachable to the safety supporting structure and is attachable to the safety attachment element of this wall cladding element.

The safety element is designed to be fire resistant and may be in class A or in class B-s1 d0 according to EN13501-1. To this end, it may be made of a fire-resistant material, or be clad in a fire-resistant material, by providing it with a fire-resistant coating for example.

This safety element is preferably in class A.

Materials in class A are non-combustible and do not contribute to the development of a fire. Materials in class B are combustible to a very limited degree. Because of this, there is an additional requirement relating to smoke development and droplet formation.

Many fire deaths are due to asphyxiation. Limiting smoke development is therefore another important aspect of fire safety. On the basis of their smoke production, materials are assigned the label s1, s2 of s3, where s1 represents limited smoke development and s3 represents substantial smoke development.

Burning droplets may cause burn injuries and cause delays when evacuating a building. The degree to which a material forms droplets in a fire is classed as d0, d1 or d2. Materials in class d0 form no droplets at all, whereas materials in class d2 form droplets that burn for longer than 10 seconds.

By providing such a wall cladding according to the disclosure with such safety elements, its fire safety can be improved in a straightforward manner without all structure attachment elements made of plastic having to be replaced with structure attachment elements made of fire-resistant material. In this way, the known advantages of structure attachment elements made of plastic can still advantageously be applied in a fire safe-wall cladding.

The safety attachment element may be provided separately from the cladding attachment element of the wall cladding element.

Preferably, the cladding attachment element and the safety element are embodied by one and the same attachment element. More preferably still, the cladding attachment element is also designed as a safety element. In this way, less material is needed to produce this safety element and it is cheaper to produce. In such an embodiment, additional cladding attachment elements may also be provided alongside this attachment element which is designed as a cladding attachment element and as a safety attachment element.

The safety supporting structure preferably forms part of the supporting structure of the wall cladding, so that less material is needed to produce both.

In such an embodiment, a safety element is preferably attachable to the supporting structure separately from the structure attachment element.

In a mounted state of the wall cladding in which the corresponding wall cladding element is supported by the structure attachment element, the safety element does not necessarily have to have a supporting function. Only when this structure attachment element melts away in a fire does this safety element prevent the wall cladding element from coming loose and falling.

In a preferred embodiment, the structure attachment element is attachable to the supporting structure in such a way that this structure attachment element is movable in a first direction relative to this supporting structure. In this case, the safety element then is attachable to the safety supporting structure in such a way that this safety element is likewise movable in this first direction relative to the safety supporting structure.

Attaching wall cladding elements with such movable structure attachment elements and corresponding cladding attachment elements allows smooth mounting, wherein tolerances and deviations in the event of thermal expansion can easily be compensated for.

More preferably still, in a state in which the structure attachment element and the cladding attachment element are mutually coupled, the structure attachment element and the cladding attachment element are then in this case mutually movable in a second direction, different from the first direction. Additionally, in a state in which the safety element and the safety attachment element are mutually coupled, the safety element and the safety attachment element are then preferably mutually movable in the second direction.

Said directions are in each case directions viewed at the location of said structure attachment element. Where the supporting structure comprises corners or curves, these directions may differ from one another for various structure attachment elements which are arranged in a distributed manner over this supporting structure.

The second direction differs from the first direction and is preferably at right angles to this first direction.

The movable attachments are in each case preferably produced as slidable attachments.

Each wall cladding element is preferably, viewed in the second direction, attached to a plurality of structure attachment elements by means of one or more cladding attachment elements.

Furthermore, each wall cladding element is, viewed in the first direction, preferably attached at a plurality of positions relative to one or more structure attachment elements by means of one or more cladding attachment elements.

The structure attachment element and the cladding attachment element are furthermore preferably provided with respective corresponding fitting elements for mutual attachment.

In such a case, the fitting element of the structure attachment element or the cladding attachment element may for example be fittable into the fitting element of the cladding attachment element or the structure attachment element, respectively, wherein these fitting elements are mutually attached by means of form-fitting and/or force-fitting.

In a particularly preferred embodiment, the structure attachment element is provided with a plurality of such fitting elements which, viewed in the first direction, are arranged in a distributed manner relative to one another and/or the cladding attachment element is provided with a plurality of said fitting elements which, viewed in the first direction, are arranged in a distributed manner relative to one another, so that the structure attachment element and the cladding attachment element are mutually attachable at a plurality of respective fitting positions, wherein the corresponding wall cladding element assumes a plurality of corresponding positions, viewed in the plane in which the wall cladding mainly lies in the mounted state.

Said plane is a plane viewed at the location of said structure attachment element.

Providing such a structure attachment element so as to be movable allows only relatively small tolerances to be compensated for in a smooth way when attaching a wall cladding element. Such structure attachment elements typically have to be arranged in virtually the correct position first. Either they have to be fixed in the desired position or the movability is such that relatively large movements are prevented by friction. In the case of relatively large tolerances and/or variations regarding wall cladding elements, moving such structure attachment elements over a relatively large distance is a laborious undertaking.

By additionally providing several fitting elements so that the wall cladding elements are attachable at a plurality of corresponding positions, it is now also possible to compensate for relatively large tolerances in a smooth way. In this way, wall cladding elements can be attached smoothly at a plurality of positions. In this case, it is also possible to attach wall cladding elements with different dimensions to the supporting structure in a smooth way.

The safety element and the safety attachment element are also preferably provided with respective corresponding fitting elements for mutual attachment.

In such a case, the fitting element of the safety element or the safety attachment element may also for example be fittable into the fitting element of the safety attachment element or the safety element, respectively, wherein these fitting elements are mutually attached by means of form-fitting and/or force-fitting.

Preferably, the safety element is also preferably provided with a plurality of such fitting elements which, viewed in the first direction, are arranged in a distributed manner relative to one another and/or the safety attachment element is provided with a plurality of such fitting elements which, viewed in the first direction, are arranged in a distributed manner relative to one another, so that the safety element and the safety attachment element are mutually attachable at a plurality of respective fitting positions.

In a specific embodiment, the supporting structure comprises a plurality of attachment profiles and the safety supporting structure comprises at least one attachment profile, wherein all of said attachment profiles are arranged parallel to one another. Each wall cladding element is then preferably attachable to a plurality of said attachment profiles of the supporting structure by means of at least one said structure attachment element made of plastic. Per wall cladding element, one said safety element is then preferably provided for attachment of said wall cladding element to said attachment profile of the safety attachment structure.

When these attachment profiles are arranged one above the other in a mounted state, wherein they may run mainly horizontally for example, the attachment profile of the safety supporting structure is preferably arranged above the centre of mass of this wall cladding element.

In this case, the safety element is preferably attachable at the top of this attachment profile, since this allows easier mounting of this safety element. Alternatively, but less preferably, provision may be made for the safety element to be attachable around the attachment profile, or attachable at the bottom of this attachment profile.

To secure against vandalism and for burglar resistance, preferably at least two said safety elements are provided per wall cladding element, by means of which safety elements said wall cladding element is attached to two corresponding attachment profiles.

The attachability of the structure attachment element and the safety element may be provided in many known ways, including screwing, click-fitting, hooking, form-fitting, etc.

In a preferred embodiment, the structure attachment element and the cladding attachment element are mutually attachable by means of a click-fit connection. Such a click-fit connection affords a particularly smooth mutual connection. In this case, such a click-fit connection is preferably formed in a direction perpendicular to said directions for ease of mounting and transmission of forces.

In a preferred embodiment, the safety element is attachable to the safety supporting structure by means of a click-fit connection and/or a hook connection and/or is attachable to the safety attachment element by means of a click-fit connection and/or a hook connection.

To secure against vandalism and for burglar resistance, the safety element is then preferably be attachable to the safety supporting structure by means of a first barb and is attachable to the safety attachment element by means of a second barb. A plurality of first and second barbs may also be provided.

There are various fire-resistant materials of which the safety elements of a wall cladding according to this disclosure may be made, such as steel or aluminium for example. Preferably, such a safety element is made of spring steel. Alternatively, the safety element may be provided with an outer layer made of fire-resistant material.

The structure attachment elements made of plastic may be made of one plastic or of a plurality of plastics. These may for example be made by injection-moulding. In such a case, the plastic is preferably chosen so that it is easily able to compensate for thermal expansion and so that elastically movable attachment parts, such as fitting ribs for example, may easily be produced therewith.

The parts of the supporting structure and of the safety supporting structure according to this disclosure may be made of materials that are typical for such a supporting structure.

Said attachment profiles may for example be made of aluminium. To ensure even greater fire safety, these may also be made of a more fire-resistant material, such as steel for example.

Said attachment profiles may for example be formed by extrusion.

The wall cladding elements of a wall cladding according to this disclosure may likewise be made of materials that are typical for such wall cladding elements, such as aluminium for example. To ensure even greater fire safety, these wall cladding elements may also be made of a more fire-resistant material.

The wall cladding elements may be formed as tiles, plates, etc. In a specific embodiment of a wall cladding according to this disclosure, the wall cladding elements are designed as slats.

Such slats may for example be formed by extrusion, wherein the cladding attachment elements may simultaneously be formed by extrusion.

Such slats may be positioned horizontally, vertically or obliquely.

BRIEF DESCRIPTION OF THE FIGURES

This disclosure will now be explained in greater detail by means of the following description of some preferred wall claddings according to this disclosure. The sole aim of this description is to give illustrative examples and to indicate further advantages and features of these wall claddings and can therefore by no means be interpreted as limiting the scope of application of the disclosure or of the patent rights defined in the claims.

In this description, reference numerals are used to refer to the attached drawings, in which:

FIGS. 5 to 10 are views and perspective views showing how a slatwall (1) according to this disclosure can be mounted, wherein:

FIG. 5 shows an attachment profile with a structure attachment element attached thereto in top view, with a slat and a safety element in an unmounted state;

FIG. 6 shows the elements from FIG. 5 in perspective;

FIG. 7 shows the elements from FIG. 5 in top view, wherein the slat is attached to the structure attachment element and wherein the safety element is attached to the slat separately from the attachment profile;

FIG. 8 shows the elements from FIG. 6 in perspective;

FIG. 9 shows the elements from FIG. 5 in a mounted state in side view;

FIG. 10 shows the elements from FIG. 9 in perspective;

DETAILED DESCRIPTION

Figure 1:
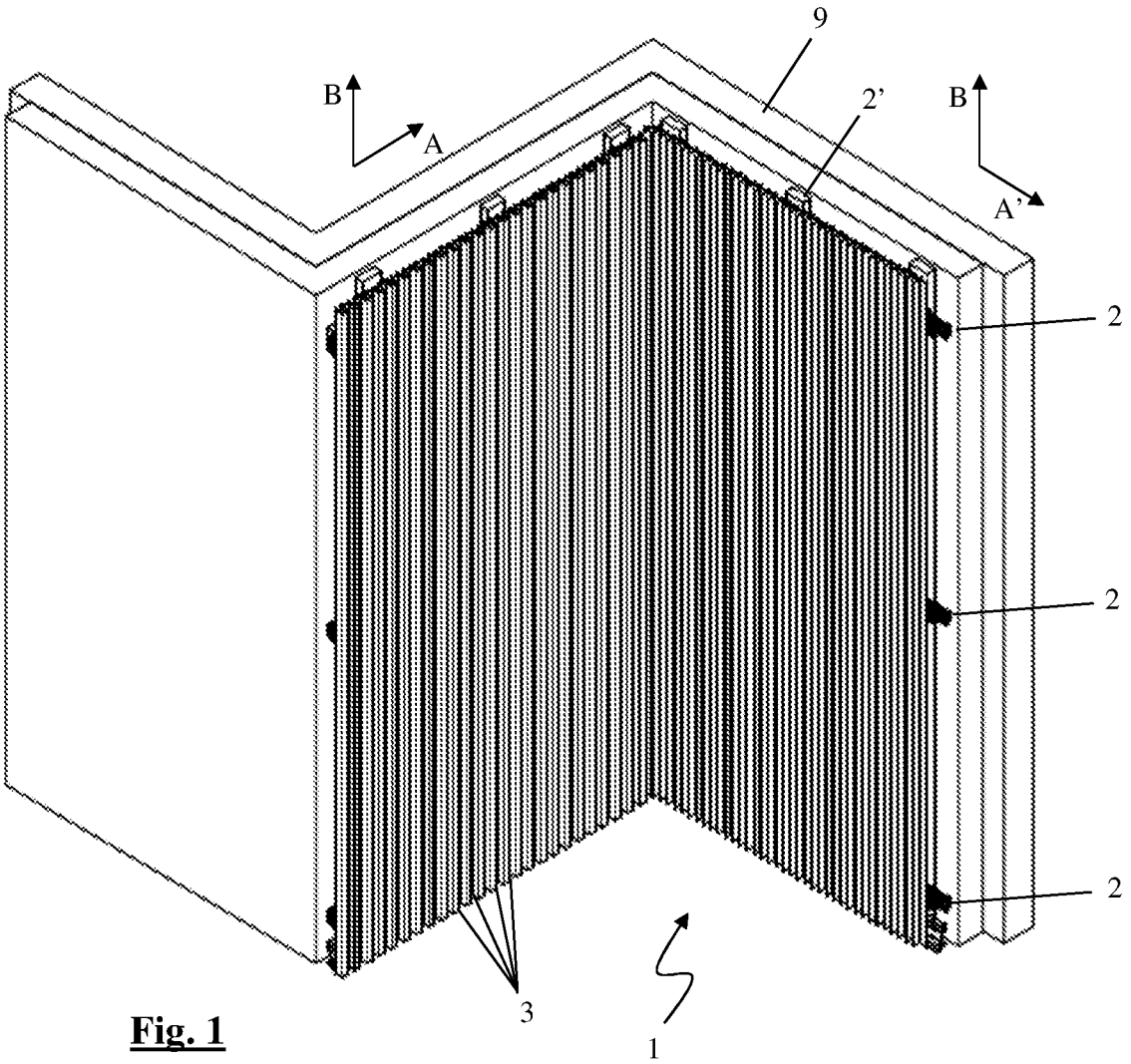
FIG. 1 shows a slatwall (1) according to this disclosure in perspective.
Figure 2:
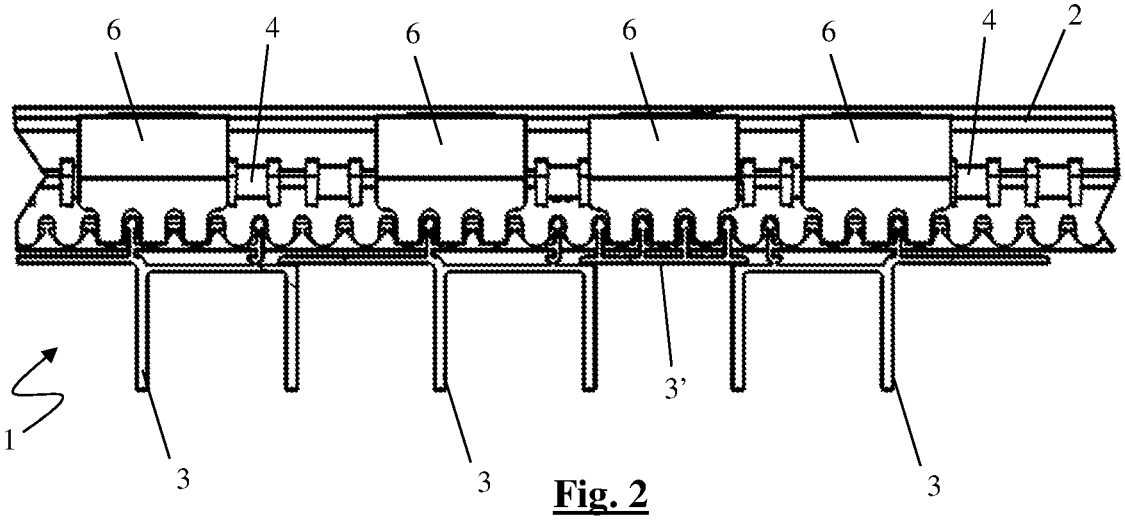
FIG. 2 shows part of the slatwall (1) from FIG. 1 in top view.
Figure 3:
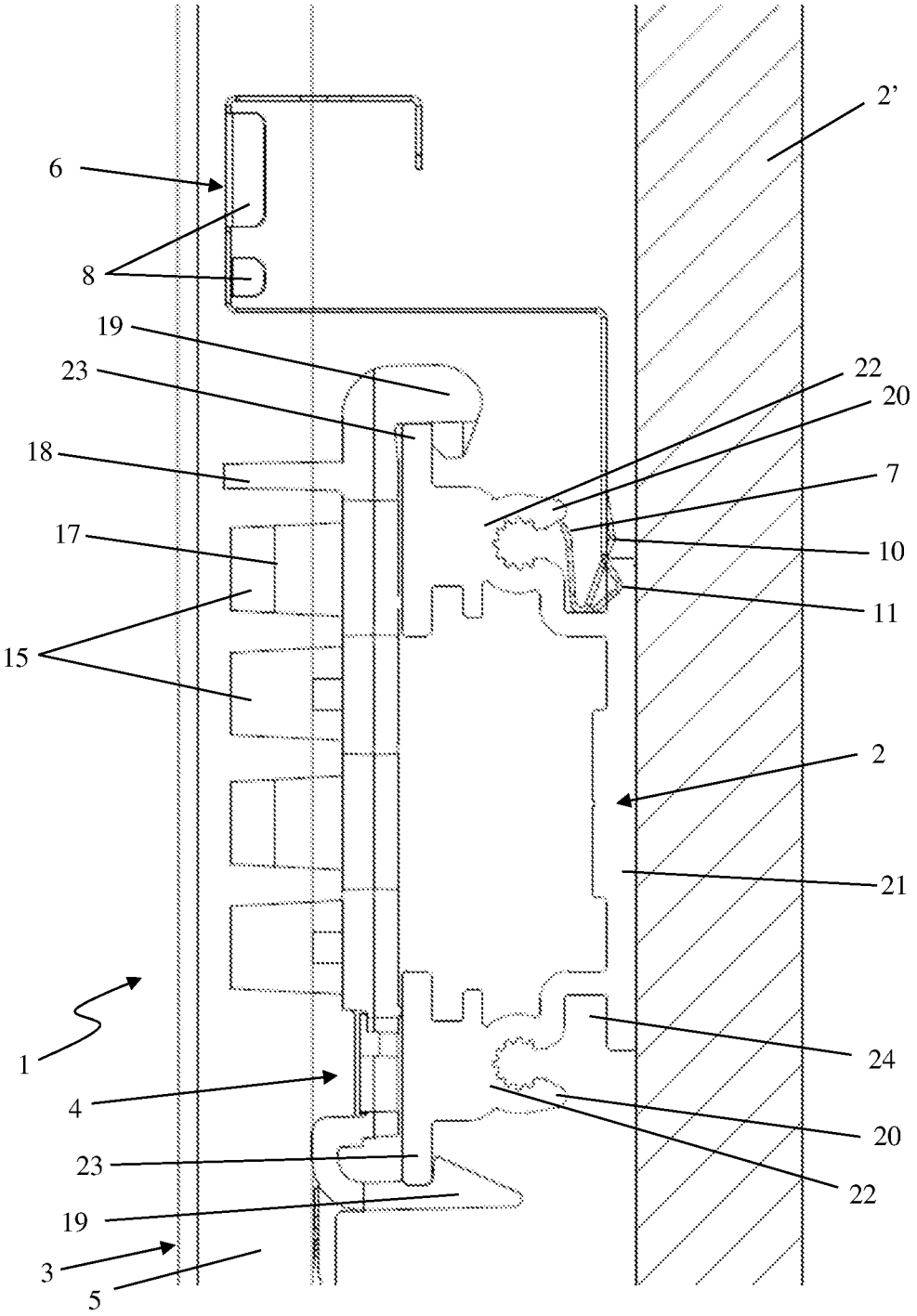
FIG. 3 shows part of the slatwall (1) from FIG. 1 in side view.
Figure 4:
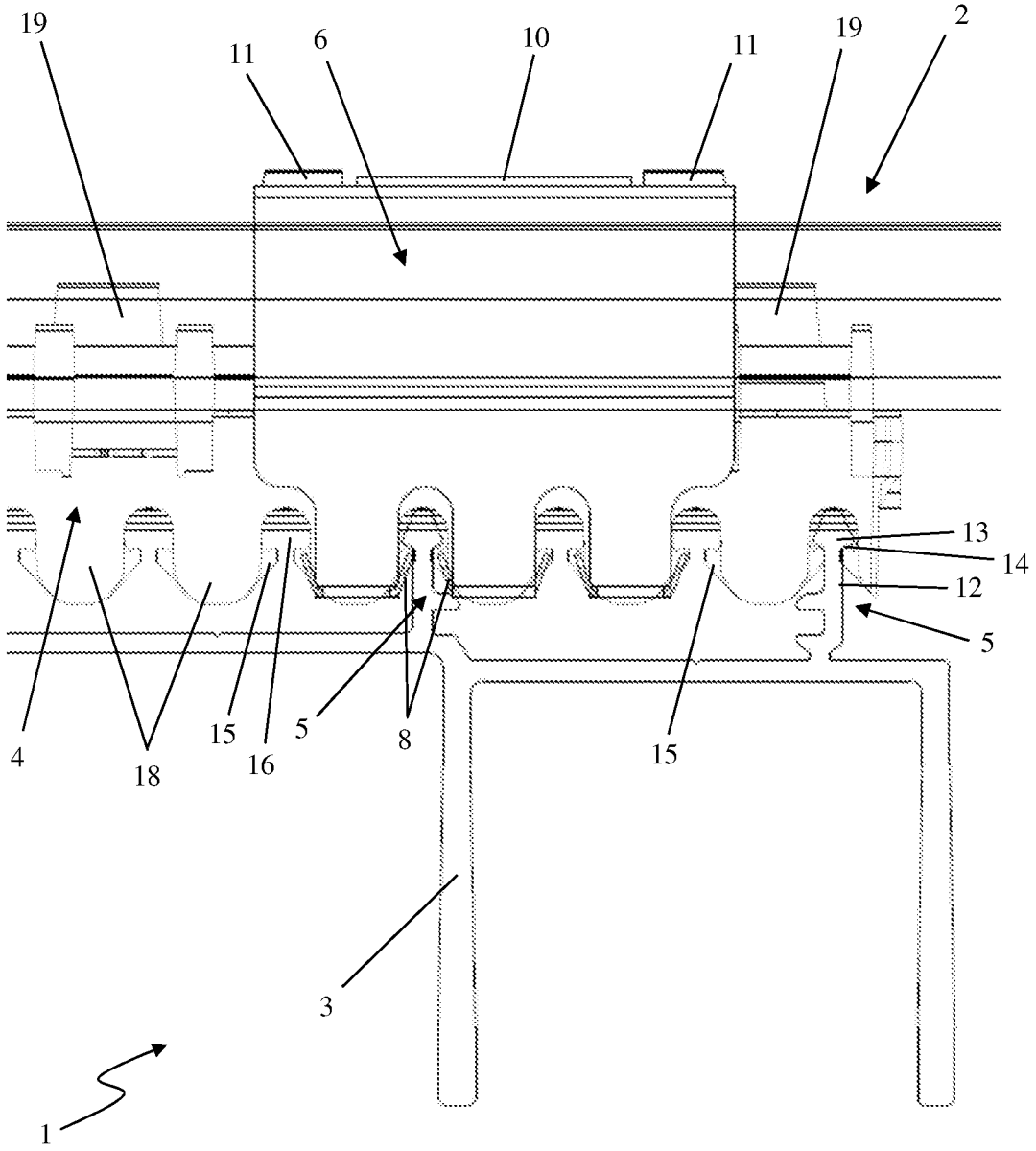
FIG. 4 shows part of the slatwall (1) from FIG. 1 in a view from above in greater detail.
Figure 5:
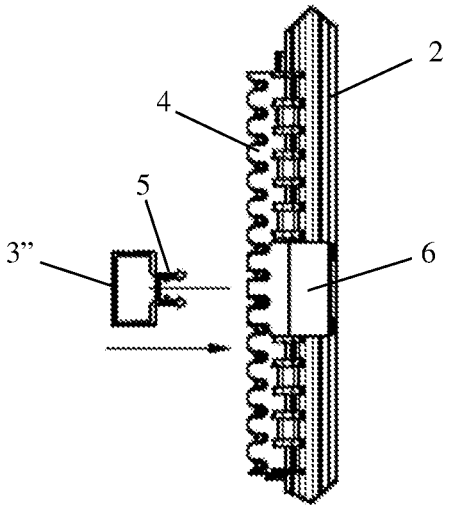
Figure 6:
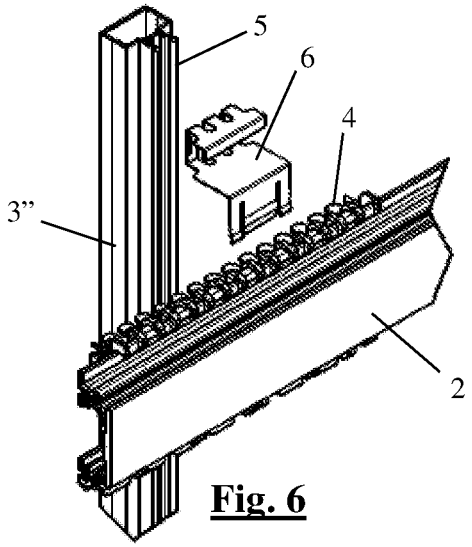
Figure 7:
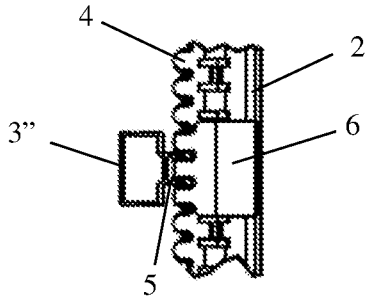
Figure 8:
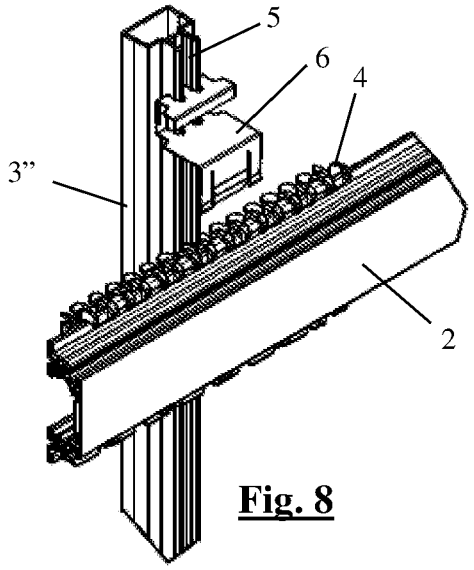
Figure 9:
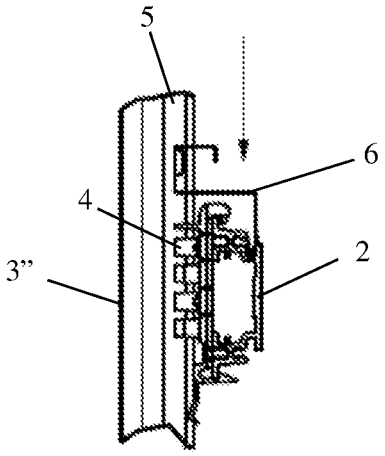
Figure 10:
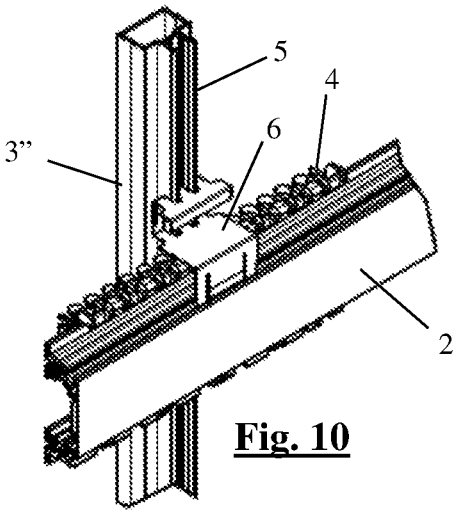
Figure 11:
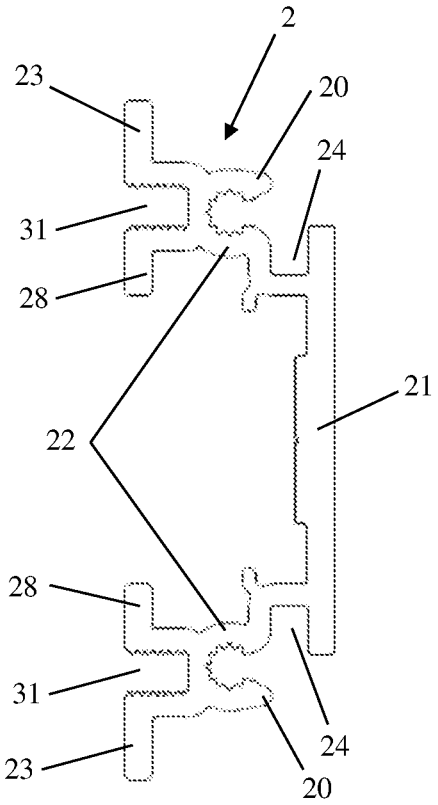
FIG. 11 shows an attachment profile (2) of the slatwall (1) from FIG. 1 separately in cross section.

The slatwall (1) shown in FIG. 1 forms a vertical wall comprising various wall parts which are arranged at an angle relative to one another. Alternatively, a vertical, substantially curved wall could be formed using the elements of this slatwall (1) Furthermore, substantially horizontal walls, oblique walls, etc. may also be formed using slatwalls (1) according to this disclosure.

The slatwall (1) shown comprises a plurality of attachment profiles (2), which are arranged parallel to one another. In FIG. 1, these attachment profiles (2) are attached to wooden battens (2') on a wall (9) so as to be able to arrange insulation between the wall (9) and the wall cladding elements (3, 3', 3"). These attachment profiles (2) could also be attached to a wall directly or be attached differently to such a wall in a floating manner. These could also, for example, be attached separately from such a wall, such as to posts for example.

In the figures, the attachment profiles (2) run substantially horizontally. These could also run vertically and could, for example, serve as posts themselves. These attachment profiles (2) could also be arranged obliquely.

The attachment profiles (2) shown in the figures are substantially straight in their longitudinal direction. They could also be designed to curve.

The attachment profiles (2) shown may, for example, be made from aluminium by extrusion.

The supporting structure (2, 2') shown comprises said attachment profiles (2) and wooden battens (2'). This supporting structure could however equally be a wall, a panel, laths, posts, etc.

The attachment profiles (2) shown comprise a bottom (21) and two walls (22) which are upright relative to this bottom (21). These are attached by their bottom (21) to underlying structure elements (2', 9) by fitting screws through this bottom (21). Outward-directed flanges (23) and inward-directed flanges (28) are provided at the ends of the upright walls, with a screw channel (31) between each of the pairs of flanges (23, 28). Fitting slots (24) are provided on the outsides of the upright walls (22). There are of course many conceivable variants for the structure of such an attachment profile (2).

A plurality of structure attachment elements (4) are attached to each of the attachment profiles (2) shown.

For the possible structure and advantages of such structure attachment elements (4), reference may also be made to WO 2018/220480 A1.

Figure 12:
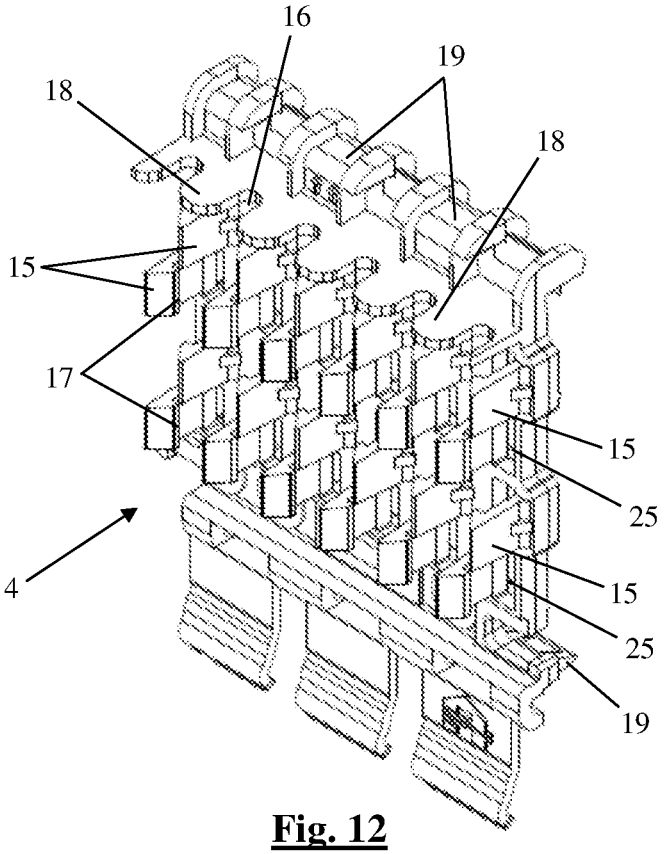
FIG. 12 shows a structure attachment element (4) of the slatwall (1) from FIG. 1 separately in perspective.
Figure 13:
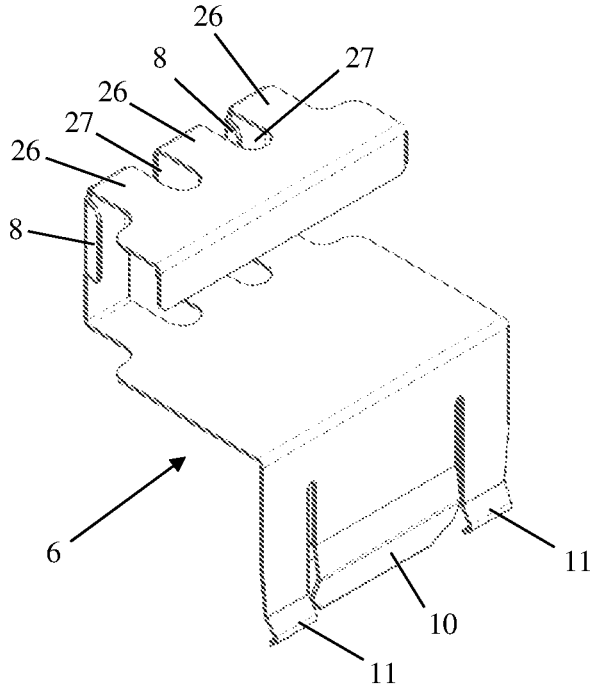
FIG. 13 shows a safety element (6) of the slatwall (1) from FIG. 1 separately in perspective.
Figure 14:
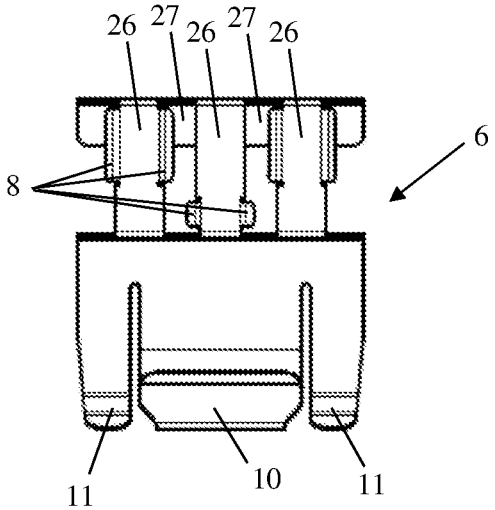
FIG. 14 shows the safety element (6) from FIG. 13 in front view.

To attach the structure attachment elements (4) to the attachment profiles (2) shown, the structure attachment elements (4) comprise hook-shaped elements (19) which are fitted over the outward-directed flanges (23) of the attachment profile (2), so that these flanges (23) of the attachment profiles (2) are in form-fitting contact with the structure attachment elements (4) attached thereto. The hook-shaped elements (19) are provided in such a manner that the structure attachment elements (4) can be click-fitted, by hooking the hook-shaped elements (19) shown at the top of in FIG. 12 over the corresponding flange (23) of the attachment profile (2) and clicking the bottom hook-shaped elements (19) over the corresponding flange (23) of the attachment profile (2). In this case, the structure attachment elements (4) are still able to slide in a first direction (A)—which here corresponds to the longitudinal direction of the corresponding attachment profile (2)—relative to this attachment profile (2). This structure attachment element (4) may then, in its mounted state, be fixed relative to this attachment profile (2), for example by means of one of more screws.

Each structure attachment element (4) shown comprises a plurality of protruding fitting ribs (15). Once the structure attachment element (4) has been attached to an attachment profile (2), these fitting ribs (15) are arranged in a distributed manner over the longitudinal direction of this attachment profile (2). These fitting ribs (15) define corresponding fitting slots (16). Each fitting rib (15) is provided with an undercut (17). The structure attachment element (4) further comprises guiding arcs (18) for the fitting slots (16).

The slatwalls (1) shown also further comprise a plurality of slats (3, 3', 3"), each of which is provided with a plurality of fitting ribs (12) with a widened head (13) as cladding attachment elements (5). FIGS. 2 and 5-10 show slats (3, 3") which comprise two fitting ribs (12) and a slat (3') which comprises four fitting ribs (12). Slats could of course also be provided with more or fewer fitting ribs (12). The slats (3, 3', 3") shown may, for example, be made of aluminium by extrusion.

These slats (3, 3', 3") are attachable to the structure attachment elements (4) by fitting these fitting ribs (12) into corresponding fitting slots (16), so that the widened head (13) can grip behind the undercuts (17). When fitting the slats (3, 3', 3"), the fitting ribs (8) are guided by the guiding arcs (18) into the corresponding fitting slots (16). In this case, the slats (3, 3', 3") are then movable in a second direction (B), at right angles to the first direction (A), relative to these structure attachment elements (4).

The slats (3, 3', 3") may be click-fitted into one or more structure attachment elements (4) at a plurality of positions in the longitudinal direction of the attachment profiles (2) In this case, successive fitting slots (16) define successive positions for the click-fitting of the slats (3, 3', 3").

According to the disclosure, the slatwall (1) shown also comprises safety elements (6, 6', 6").

Per slat (3, 3', 3"), at least one such safety element (6, 6', 6") is attached to the attachment profile (2) on one side, and to this slat (3, 3', 3") on the other side. For reasons of fire safety, this safety element (6, 6', 6") is preferably attached to the uppermost attachment profile (2). In addition, an additional safety element (6, 6', 6") may be provided per slat (3, 3', 3") so that the slats (3, 3', 3") are less readily detachable, for example to secure against vandalism and for burglar resistance.

In the embodiment shown in FIGS. 1-14, each safety element (6) is attached at the top of the corresponding attachment profile (2).

To this end, this safety element (6) comprises downward-directed click-fit legs (10, 11), by means of which this safety element (6) can be click-fitted into the fitting slot (24) at the top of the attachment profile (2). For this, the middle click-fit leg (10) is provided with a barb (7) which can be hooked behind an overhanging edge (20) which is situated above the fitting slot (24) and forms part of the attachment profile (2).

In this case, the safety element (6) then still remains slidable in the first direction (A) relative to this attachment profile (3, 3', 3").

This fitting slot (24) remains accessible when a structure attachment element (4) is attached to the attachment profile (2), so that the safety element (6) is attachable to the attachment profile (2) separately from this structure attachment element (4).

To attach the corresponding slat (3, 3', 3") to this safety element (6), this safety element (6) is provided with three fitting legs (26), which define two fitting cavities (27), wherein each fitting leg (26) is provided on either side with folded fitting hooks (8), which are provided to act as barbs (8) so as to be able to hook behind the widened head (13) of the fitting ribs (12) of the slats (3, 3', 3") when these fitting ribs (12) are arranged in the fitting cavities (27). The fitting hooks (8) are arranged in an alternating distribution over the fitting legs (26) and vary in size in order to facilitate the click-fitting of the fitting ribs (12).

Instead of click-fitting one or more such fitting ribs (12) of a slat (3, 3', 3") into one or more corresponding fitting cavities (27) of this safety element (6), it is also possible, in the embodiment shown, to click-fit all of the fitting legs (26) together between two fitting ribs (12) of a slat (3).

Once the safety element (6) has been click-fitted onto the slat (3, 3', 3"), this safety element remains slidable in the second direction (B) relative to this slat (3, 3', 3").

A second such safety element (6) may also be attached at the bottom of each slat (3, 3', 3") by rotating this safety element (6) by 180°, so that the top side as seen in the figures becomes the underside. This safety element (6) may then be attached to the slat (3, 3', 3") in a similar manner and click-fitted into the bottom fitting slot (24) of the bottom attachment profile (2).

The safety element (6) shown in FIGS. 2-10 and 13-14 may for example be formed from spring steel plate by punching and bending.

To mount the wall cladding (1) shown in FIG. 1, the attachment profiles (2) may first be arranged parallel to one other. The structure attachment elements (4) are then attached to the corresponding attachment profiles (2). In each case, only the structure attachment element (4) which comes first, viewed in the first direction (A), is fixed relative to the corresponding attachment profile (2), for example by means of screws. To this end, these structure attachment elements (4) which come first are aligned relative to one other. The other structure attachment elements (4) remain slidable in the longitudinal direction relative to the corresponding attachment profile (2).

A first slat (3") is then click-fitted onto the structure attachment elements (4), as can be seen in FIGS. 5-8. For this, a corresponding safety element (6) is first click-fitted onto the slat (3") at a distance above the attachment profile (2) and then slid downwards in order to be click-fitted into this attachment profile (2), as can be seen in FIGS. 7-10. Such a safety element (6) may optionally be attached in a similar manner at the bottom as well.

The other slats (3, 3') are then click-fitted onto the structure attachment elements (4), on which the structure attachment elements (4) which are still slidable will be slid into their desired end position. The desired safety elements (6) are also secured per slat (3, 3').

The structure attachment elements (4) which come last may then be aligned again relative to one another. If their position deviates excessively from the desired position, the intermediate structure attachment elements (4) and safety elements (6) may be moved as necessary relative to the corresponding attachment profiles (2) in order to achieve the desired end position.

Figure 15:
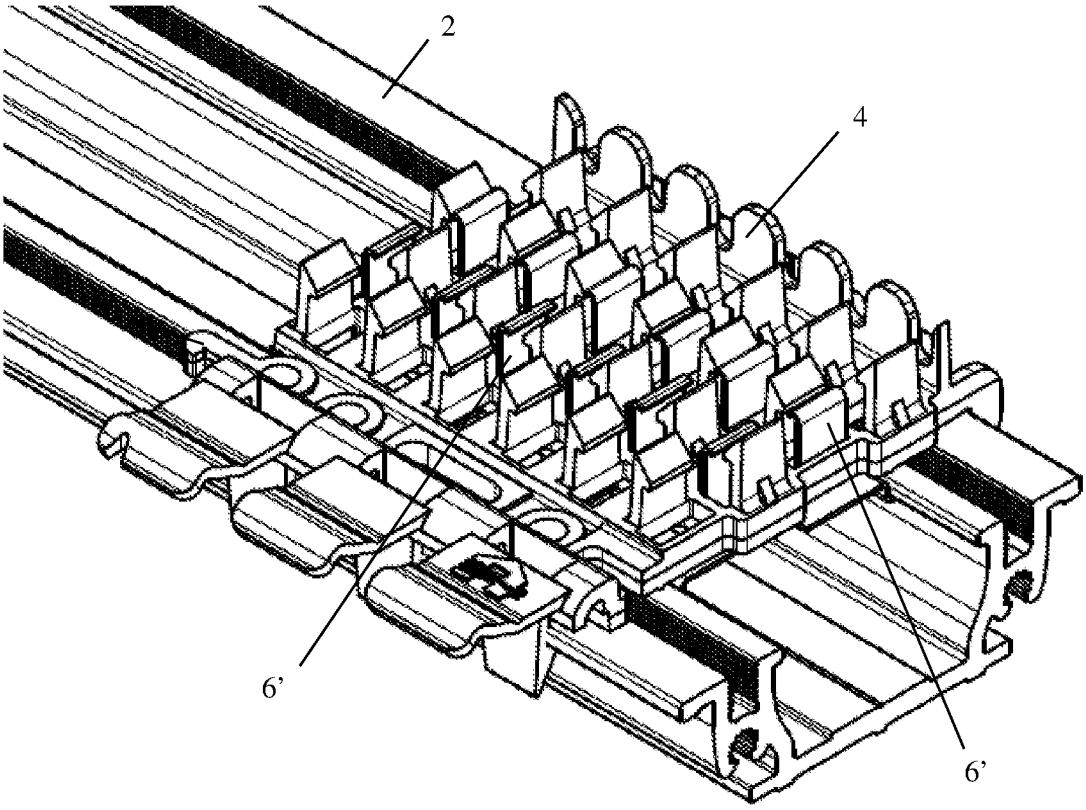
FIG. 15 shows, in perspective, an attachment profile (2) of the slatwall (1) from FIG. 1 with, attached thereto, a structure attachment element (4) with, alternatively attached thereto, a safety element (6')
Figure 17:
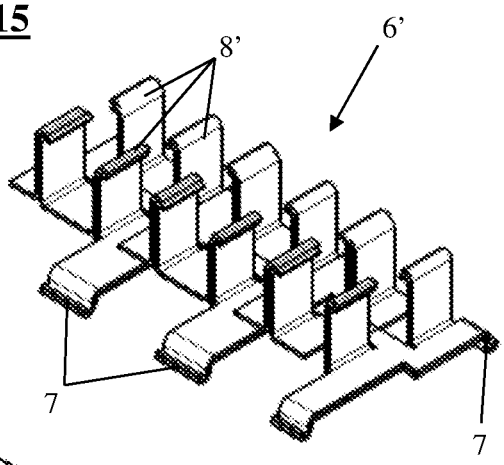
FIG. 17 shows the safety element (6') from FIG. 15 separately in perspective.
Figure 16:
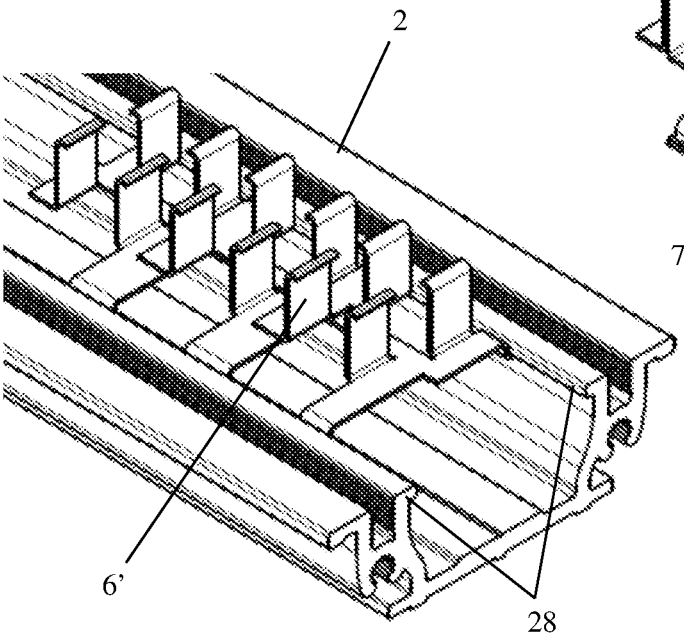
FIG. 16 shows the attachment profile (2) from FIG. 15 with the safety element (6') attached thereto separately in perspective.

A first alternative embodiment of a safety element (6') according to this disclosure is shown in FIGS. 15-17.

This safety element (6') may likewise be made of spring steel.

This safety element (6') comprises folded click-fit legs (7) by means of which the safety element (6') is click-fittable into a corresponding attachment profile (2). In this case, the click-fit legs (7) continue to hook securely behind the inward-directed flanges (28) of this attachment profile (2) as barbs, as can be seen in FIG. 16.

In addition, this safety element (6') comprises protruding fitting ribs (8') which work together in a similar way to the above-described fitting ribs (15) of the structure attachment element (4) shown, so as to be able to click-fit the fitting ribs (12) of a slat (3, 3', 3") therebetween.

The structure attachment element (4) shown may be arranged over this safety element (6'), wherein the fitting ribs (8') of this safety element (6') are arranged through cavities (25) in this structure attachment element (4).

Figure 18:
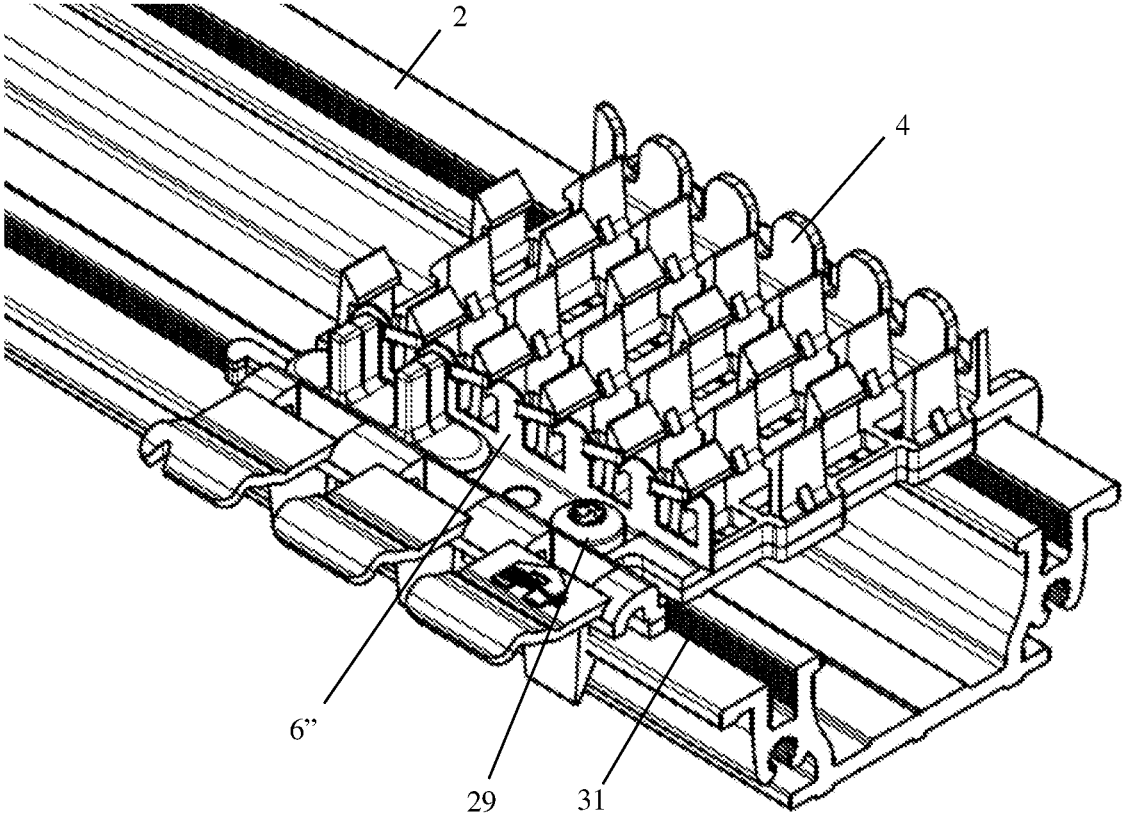
FIG. 18 shows, in perspective, an attachment profile (2) of the slatwall (1) from FIG. 1 with, attached thereto, a structure attachment element (4) with, alternatively attached thereto, a second safety element (6")
Figure 19:
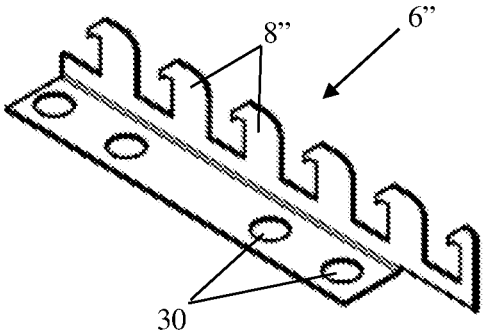
FIG. 19 shows the safety element (6") from FIG. 18 separately in perspective.

A second alternative embodiment of a safety element (6") according to this disclosure is shown in FIGS. 18-19.

This safety element (6") may also be formed from spring steel plate by punching and bending.

This safety element (6") is secured to the attachment profile (2) using a screw (29), by screwing this screw (29) through a screw hole (30) in the safety element (6") into a screw channel (31) of the attachment profile (2).

This safety element (6") is also provided with upright barbs (8") between which the fitting ribs (12) of a slat (3, 3', 3") may be click-fitted.

In the embodiments shown, the supporting structure (2, 2') for attachment of the structure attachment elements (4) may also be the safety supporting structure for attachment of the safety elements. This safety supporting structure could, however, also attach the safety elements (6, 6', 6") separately from the supporting structure (2, 2').

Furthermore, in the embodiments shown, the cladding attachment elements (5) of the slats may also be the safety attachment elements. These safety attachment elements could, however, also be separate from the cladding attachment elements (5).

The invention claimed is:

1. Wall cladding, comprising:

a supporting structure;

wall cladding elements;

at least one structure attachment element made of non-fire-resistant plastic, wherein the at least one structure attachment is attachable to the supporting structure;

at least one cladding attachment element per each wall cladding element, wherein the at least one cladding attachment element forms part of each respective wall cladding element or is attached thereto and is couplable to the at least one structure attachment element so as to attach the wall cladding element to the supporting structure;

wherein the wall cladding comprises a safety supporting structure, at least one safety attachment element per each wall cladding element, wherein the at least one safety attachment element forms part of each respective wall cladding element or is attached thereto, and at least one safety element per each wall cladding element, wherein the at least one safety element is designed to be fire-resistant, is attachable to the safety supporting structure, and is attachable to the at least one safety attachment element of the wall cladding element.

2. Wall cladding according to claim 1, wherein the at least one cladding attachment element and the at least one safety attachment element are embodied by one and the same attachment element.

3. Wall cladding according to claim 1, wherein the safety supporting structure forms part of the supporting structure.

4. Wall cladding according to claim 3, wherein the at least one safety element is attachable to the supporting structure separately from the at least one structure attachment element.

5. Wall cladding according to claim 1, wherein the at least one structure attachment element is attachable to the supporting structure in such a way that the at least one structure attachment element is movable in a first direction relative to the supporting structure, and wherein the at least one safety element is attachable to the safety supporting structure in such a way that the at least one safety element is movable in this first direction relative to the safety supporting structure.

6. Wall cladding according to claim 5, wherein, in a state in which the at least one structure attachment element and the at least one cladding attachment element are mutually coupled, the at least one structure attachment element and the at least one cladding attachment element are mutually movable in a second direction, different from the first direction, and wherein, in a state in which the at least one safety element and the at least one safety attachment element are mutually coupled, the at least one safety element and the at least one safety attachment element are mutually movable in the second direction.

7. Wall cladding according to claim 1, wherein the supporting structure comprises a plurality of attachment profiles and the safety supporting structure comprises at least one attachment profile, wherein all of the plurality of attachment profiles are arranged parallel to one another, wherein each wall cladding element is attachable to the at least one attachment profile of the supporting structure by at least one said structure attachment element made of non-fire-resistant plastic and wherein, per each wall cladding element, the at least one safety element is provided for attachment of the wall cladding element to the at least one attachment profile of the safety attachment structure.

8. Wall cladding according to claim 7, wherein the plurality of attachment profiles are arranged one above the other in a mounted state, and wherein the at least one attachment profile of the safety supporting structure is arranged above the center of mass of the wall cladding element.

9. Wall cladding according to claim 7, wherein the at least one safety element is attachable at the top of a corresponding the at least one attachment profile.

10. Wall cladding according to claim 8, wherein the at least one safety element comprises at least two safety elements, the at least two safety elements being provided per each wall cladding element, such that the wall cladding element is attached to two corresponding attachment profiles by the at least two safety elements.

11. Wall cladding according to claim 1, wherein the at least one safety element is attachable to the safety supporting structure by a click-fit connection and/or a hook connection and/or is attachable to the at least one safety attachment element by a click-fit connection and/or a hook connection.

12. Wall cladding according to claim 11, wherein the at least one safety element is attachable to the safety supporting structure by a first barb and is attachable to the at least one safety attachment element by a second barb.

13. Wall cladding according to claim 1, wherein the at least one safety element is made of spring steel.

14. Wall cladding according to claim 1, wherein the wall cladding elements are designed as slats.

15. Wall cladding according to claim 1, wherein the at least one structure attachment element is directly couplable to the at least one cladding attachment element.

* * * * *